US006929456B2

(12) United States Patent
Seo

(10) Patent No.: US 6,929,456 B2
(45) Date of Patent: Aug. 16, 2005

(54) VALVE ASSEMBLY FOR RECIPROCATING COMPRESSORS

(75) Inventor: Seung Don Seo, Suwon (KR)

(73) Assignee: Samsung Gwang Ju Electronics Co., Ltd., Kwangju (KR)

( * ) Notice: Subject to any disclaimer, the term of this patent is extended or adjusted under 35 U.S.C. 154(b) by 142 days.

(21) Appl. No.: 10/600,019

(22) Filed: Jun. 20, 2003

(65) Prior Publication Data

US 2004/0202563 A1 Oct. 14, 2004

(30) Foreign Application Priority Data

Apr. 8, 2003 (KR) ..... 10-2003-0021822

(51) Int. Cl.[7] ..... F04B 39/10
(52) U.S. Cl. ..... 417/569
(58) Field of Search ..... 137/856; 417/559, 417/569, 571

(56) References Cited

U.S. PATENT DOCUMENTS

| | | | | | |
|---|---|---|---|---|---|
| 4,723,896 | A | * | 2/1988 | Fritchman | 417/571 |
| 5,249,939 | A | * | 10/1993 | Takahashi | 417/569 |
| 5,379,799 | A | * | 1/1995 | Kawai et al. | 137/856 |
| 5,577,901 | A | * | 11/1996 | Yoon | 417/571 |
| 6,174,147 | B1 | * | 1/2001 | Tarutani et al. | 417/569 |
| 6,796,331 | B1 | * | 9/2004 | Lacroix | 417/569 |

FOREIGN PATENT DOCUMENTS

JP 10-110678 4/1998

OTHER PUBLICATIONS

Patent Abstracts of Japan Publication No.: 10–110678 Dated Apr. 28, 1998.

* cited by examiner

*Primary Examiner*—Michael Koczo, Jr.
(74) *Attorney, Agent, or Firm*—Ladas & Parry LLP

(57) ABSTRACT

A valve assembly for the reciprocating compressors, elements of which are easily and simply assembled into a single body, and which reduces operational impact and noise caused by an operation of a reed valve, thus allowing a silent operation of the reciprocating compressors. The valve assembly includes an exhaust hole plate having an exhaust hole, a reed valve plate having a reed valve, a stopper plate having a stopper, and a pressure unit formed on a lower surface of a cylinder head, wherein the exhaust hole plate, the reed valve plate and the stopper plate are assembled with the cylinder together with the cylinder head when the cylinder head is mounted to the cylinder. The stopper is bent at a junction end thereof at a predetermined angle of inclination, so that a free end of the stopper is raised toward the cylinder head. The pressure unit includes a first pressure projection to compress the junction end of the stopper, a second pressure projection to compress the free end of the stopper, and a third pressure projection to compress an intermediate point of the stopper between the junction and free ends. The stopper is thus supported while being shaped into a bow shape at a position between the cylinder head and the exhaust hole plate.

8 Claims, 8 Drawing Sheets

VALVE ASSEMBLY FOR RECIPROCATING COMPRESSORS

CROSS-REFERENCE TO RELATED APPLICATION

This application claims the benefit of Korean Application No. 2003-21822, filed Apr. 8, 2003, in the Korean Intellectual Property Office, the disclosure of which is incorporated herein by reference.

BACKGROUND OF THE INVENTION

1. Field of the Invention

The present invention relates, in general, to reciprocating compressors and, more particularly, to a valve assembly for the reciprocating compressors, elements of which are easily and simply assembled into a single body, and which reduces operational impact and noise caused by an operation of a reed valve, thus allowing a silent operation of the reciprocating compressors.

2. Description of the Related Art

As well known to those skilled in the art, a reciprocating compressor includes a plurality of elements, that is, a stator, a rotor, a crankshaft, a cylinder, a piston, and a cylinder head, which are hermetically housed in a hermetic casing. The stator and the rotor are installed in the hermetic casing such that the stator is immobile, while the rotor is rotatable. The crankshaft axially and fixedly penetrates through the rotor to rotate along with the rotor in response to an electromagnetic action between the stator and the rotor when the compressor is electrically turned on. The cylinder defines a chamber therein to suck and compress a gas in the chamber, while the piston is received in the cylinder so as to perform a rectilinear reciprocating motion in the cylinder, in response to a rotation of the crankshaft. The cylinder head covers a top of the cylinder. In an operation of the reciprocating compressor, the piston rectilinearly reciprocates in the cylinder in response to the rotation of the crankshaft, thus sucking a gas into the cylinder inside the hermetic casing, and compressing the gas, prior to discharging the compressed gas under high pressure from the cylinder to the outside of the hermetic casing. The reciprocating compressor having the above-mentioned construction is preferably used in a refrigeration system, such as a refrigerator or an air conditioner, to compress a gas refrigerant under low pressure to make the gas refrigerant under high pressure.

In the reciprocating compressor, a valve assembly is interposed between the cylinder and the cylinder head to control low-pressure gas suction into the cylinder inside the hermetic casing and high-pressure gas exhaust from the cylinder to the outside of the hermetic casing, during the operation of the compressor.

The conventional valve assembly for reciprocating compressors includes an exhaust valve unit having a reed valve, a stopper, and a keeper. The reed valve controls the gas exhaust from the cylinder to the outside of the hermetic casing, while the stopper limits an opening ratio of the reed valve within a predetermined range. The keeper supports the stopper. The reed valve, stopper and the keeper of the exhaust valve unit are sequentially assembled on an exhaust hole plate which has both a suction hole and an exhaust hole. The exhaust hole plate having the exhaust valve unit is set together with a suction valve plate integrally having a suction valve, at a position between the cylinder and the cylinder head by use of a plurality of bolts.

When the piston is moved from a lower dead center to an upper dead center in the cylinder, the gas is compressed in the cylinder. Pressure of the compressed gas is thus applied to the exhaust hole, so that a free end of the reed valve is elastically bent along with the stopper toward the cylinder head, thereby opening the exhaust hole. The compressed gas under high pressure is discharged from the cylinder to the outside of the hermetic casing through the cylinder head and the open exhaust hole. When the piston is moved from the upper dead center to the lower dead center in the cylinder, the reed valve elastically doses the exhaust hole, due to a restoring force of both the stopper and the reed valve, and, at the same time, the suction valve of the suction valve plate is opened to suck the gas under low pressure into the cylinder through the open suction hole and the cylinder head.

However, the conventional valve assembly for reciprocating compressors is problematic, as follows. That is, in the conventional valve assembly, the reed valve to control the exhaust hole, the stopper to limit the opening ratio of the reed valve within the predetermined range, and the keeper to support the stopper are separately produced, and are sequentially assembled on the exhaust hole plate. Therefore, it is necessary to sequentially assemble the reed valve, stopper and the keeper on the exhaust hole plate, prior to setting the exhaust hole plate between the cylinder and the cylinder head by use of a plurality of bolts. Excessive time is consumed while assembling the reed valve, stopper and the keeper into the valve assembly.

In the conventional valve assembly for reciprocating compressors, a first end of the reed valve forms a junction end at which the reed valve is mounted to the exhaust hole plate, and a second end of the reed valve forms the free end which is elastically bent from the exhaust hole plate toward the cylinder head, due to an exhaust pressure applied thereto. Therefore, the free end of the reed valve repeatedly strikes against the stopper and the exhaust hole plate during the rectilinear reciprocating motion of the piston in the cylinder, thus generating operational impact and noise. In addition, the reed valve vibrates at the free end thereof, thus generating high-frequency noise to prevent a silent operation of the reciprocating compressors.

SUMMARY OF THE INVENTION

Accordingly, it is an aspect of the present invention to provide a valve assembly for reciprocating compressors, elements of which are easily and simply assembled into a single body.

It is another aspect of the present invention to provide a valve assembly for reciprocating compressors, which reduces operational impact and noise caused by an operation of a reed valve, thus allowing a silent operation of the reciprocating compressors.

Additional aspects and advantages of the invention will be set forth in part in the description which follows and, in part, will be obvious from the description, or may be learned by practice of the invention.

The foregoing and other aspects of the present invention are achieved by providing a valve assembly for reciprocating compressors, including a cylinder, a cylinder head; and a valve assembly arranged between the cylinder and cylinder head, the valve assembly including: an exhaust hole plate having an exhaust hole communicating the cylinder, a reed valve plate, with a reed valve integrally formed in the reed valve plate so as to open or dose the exhaust hole; and a stopper plate, with a stopper integrally formed in the stopper plate so as to limit an opening ratio of the reed valve within a predetermined range, the exhaust hole plate, the reed valve plate and the stopper plate being assembled with the cylinder together with the cylinder head when the cylinder head is mounted to the cylinder.

The valve assembly further includes a pressure unit integrally formed on a lower surface of the cylinder head so as to compress the stopper to support the stopper, and allow the stopper to apply pre-pressure to the reed valve.

In the valve assembly, the reed valve is formed by cutting a predetermined portion of the reed valve plate, such that a first end of the reed valve forms a junction end, and a second end of the reed valve forms a free end.

The stopper is formed by cutting a predetermined portion of the stopper plate, such that a first end of the stopper forms a junction end, and a second end of the stopper forms a free end, the stopper being bent at the junction end thereof at a predetermined angle of inclination, so that the free end of the stopper is raised toward the cylinder head.

The pressure unit includes a first pressure projection projected from the cylinder head at a position corresponding to the junction end of the stopper, thus compressing the junction end of the stopper, a second pressure projection projected from the cylinder head at a position corresponding to the free end of the stopper, thus compressing the free end of the stopper, and a third pressure projection projected from the cylinder head at a position corresponding to an intermediate point of the stopper between the junction end and the free end of the stopper, thus compressing the intermediate point of the stopper.

The second pressure projection is slightly longer than the first pressure projection, and the third pressure projection is slightly shorter than the first pressure projection, so that the first, second and third pressure projections support the stopper while shaping the stopper into a bow shape at a position between the cylinder head and the exhaust hole plate, and the free end of the reed valve is pre-pressurized by the free end of the stopper which is compressed by the second pressure projection.

In the valve assembly, the third pressure projection is eccentrically positioned between the first and second pressure projections, and the exhaust hole is formed at the exhaust hole plate at a position corresponding to the third pressure projection.

In such a case, the third pressure projection is preferably positioned to be eccentric toward the second pressure projection.

In the valve assembly, a depression is formed on a surface of the exhaust hole plate at a position around the exhaust hole, so that the reed valve doses the exhaust hole while a part of the reed valve comes into contact with areas of the exhaust hole plate around the exhaust hole and the depression.

BRIEF DESCRIPTION OF THE DRAWINGS

These and other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
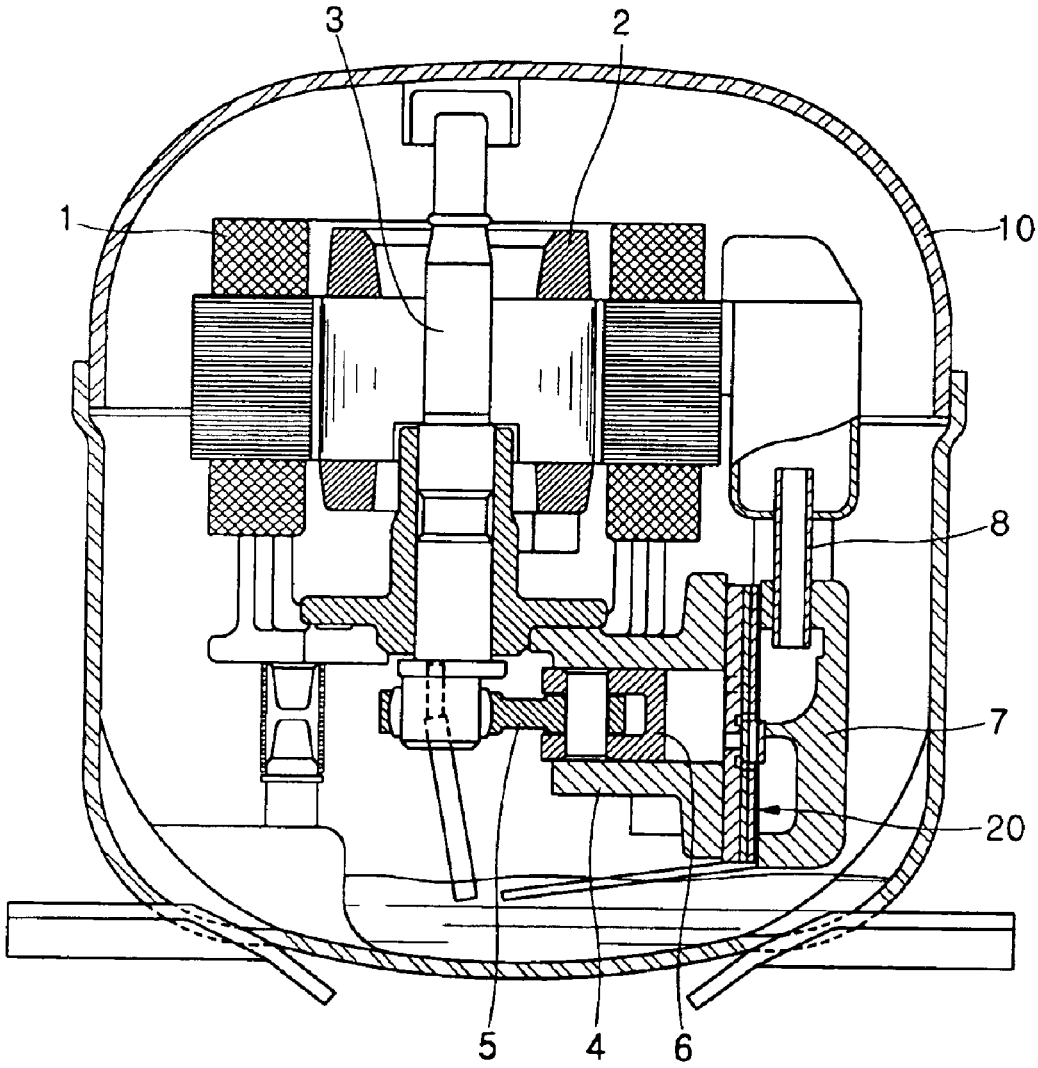
FIG. 1 is a longitudinal sectional view of a reciprocating compressor having a valve assembly, according to an embodiment of the present invention.

Reference will now be made in detail to the present preferred embodiments of the present invention, examples of which are illustrated in the accompanying drawings, wherein like reference numerals refer to like elements throughout.

FIG. 1 is a longitudinal sectional view of a reciprocating compressor having a valve assembly, according to an embodiment of the present invention. As shown in the drawing, the reciprocating compressor of the present invention includes a plurality of elements, that is, a stator 1, a rotor 2, a crankshaft 3, a cylinder 4, a piston 6, and a cylinder head 7, which are hermetically housed in a hermetic casing 10. The stator 1 and the rotor 2 are installed in the hermetic casing 10, such that the stator 1 is immobile, while the rotor 2 is rotatable. The crankshaft 3 is axially inserted into the rotor 2 to rotate along with the rotor 2. The cylinder 4 defines a compression chamber therein. The piston 6 is received in the cylinder 4, and is connected to the crankshaft 3 via a connecting rod 5. The cylinder head 7 covers a top of the cylinder 4.

A gas suction pipe 8 and a gas exhaust pipe (not shown) pass through the hermetic casing 10, and are mounted to the cylinder head 7, so that a gas is sucked into the cylinder 4 through the gas suction pipe 8. The gas is compressed in the cylinder 4, and is discharged from the cylinder 4 to the outside of the hermetic casing 10 through the gas exhaust pipe. In addition, a valve assembly 20 according to the present invention is arranged at a position between the cylinder 4 and the cylinder head 7 to control a gas suction into the hermetic casing 10 and a gas exhaust from the hermetic casing 10, during an operation of the compressor.

Figure 2:
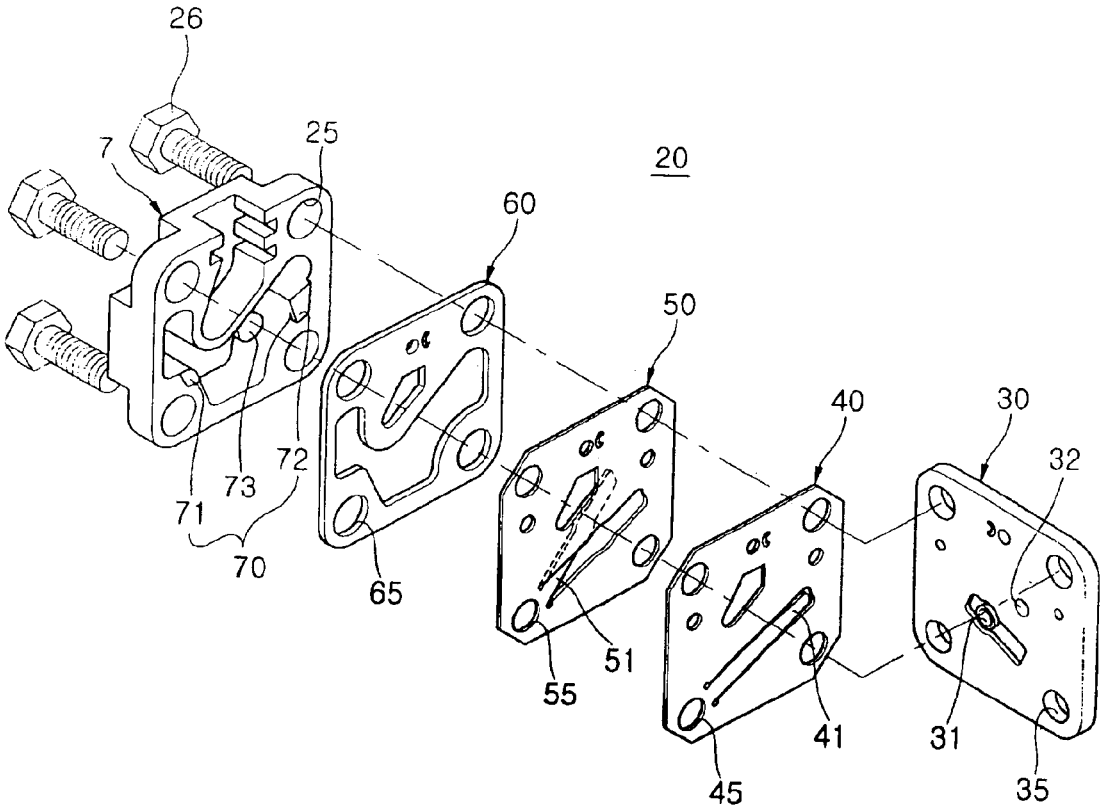
FIG. 2 is an exploded perspective view of the valve assembly of FIG. 1.

FIG. 2 is an exploded perspective view showing the construction of the valve assembly, according to the present invention. As shown in the drawing, the valve assembly 20 includes an exhaust hole plate 30 having an exhaust hole 31 communicating the cylinder 4, a reed valve plate 40 having a reed valve 41, and a stopper plate 50 having a stopper 51. In the valve assembly 20, the exhaust hole plate 30, the reed valve plate 40, and the stopper plate 50 are sequentially arranged between the cylinder 4 and the cylinder head 7.

The valve assembly 20 also has a gasket 60 and a suction valve plate (not shown). The gasket 60 is closely interposed between the cylinder head 7 and the stopper plate 50 so as to prevent a gas leakage from the junction of the cylinder head 7 and the stopper plate 50. The suction valve plate (not shown) having a suction valve is arranged under the exhaust hole plate 30, so that the suction valve controls a suction hole 32 provided at the exhaust hole plate 30.

The present invention is characterized in that the structure of both the reed valve and the stopper is improved to accomplish the aspects of the invention, so that the suction valve plate is not shown in the accompanying drawings, and further explanation for the suction valve plate is not deemed necessary.

In the valve assembly 20, all the exhaust hole plate 30, reed valve plate 40, stopper plate 50, gasket 60 and the cylinder head 7 have rectangular profiles which are chamfered or rounded at corners thereof. The exhaust hole plate 30, reed valve plate 40, stopper plate 50, and the gasket 60 are also provided with locking holes 35, 45, 55 and 65 at corners thereof. Therefore, the exhaust hole plate 30, reed valve plate 40, stopper plate 50, and the gasket 60 are assembled with each other when the cylinder head 7 is fastened to the cylinder 4 by use of bolts 26. In such a case, the bolts 26 are initially inserted into locking holes 25 provided at corners of the cylinder head 7, and sequentially pass through the locking holes 65, 55, 45 and 35 of the gasket and the three plates, prior to being tightened to the cylinder 4.

In order to compress the stopper 51 at several points to support the stopper 51 while shaping the stopper 51 into a predetermined shape so as to allow the stopper 51 to apply pre-pressure to a free end of the reed valve 41, a pressure unit 70 is provided on a lower surface of the cylinder head 7. The construction of the reed valve 41, stopper 51, and the pressure unit 70 will be described in detail herein below, with reference to FIGS. 3 to 6.

Figure 3:
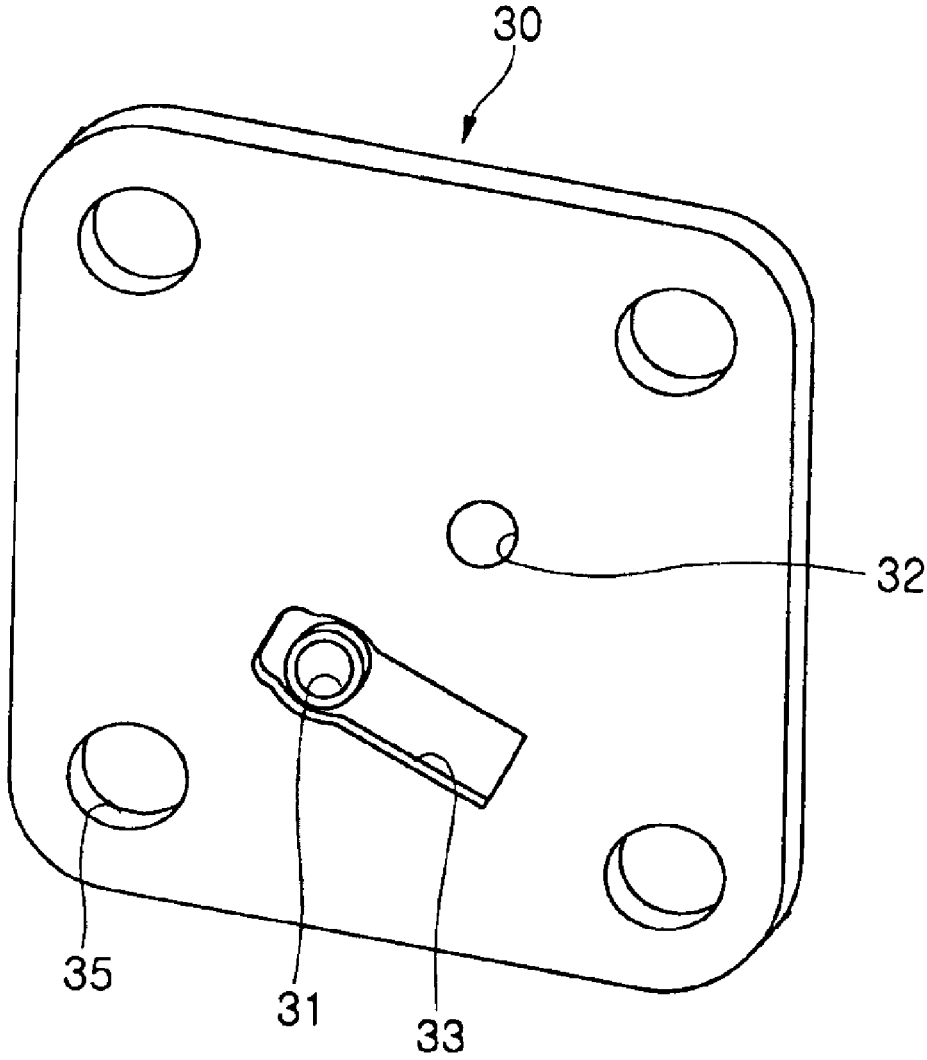
FIG. 3 is a top perspective view of an exhaust hole plate included in the valve assembly of FIG. 2.
Figure 4:
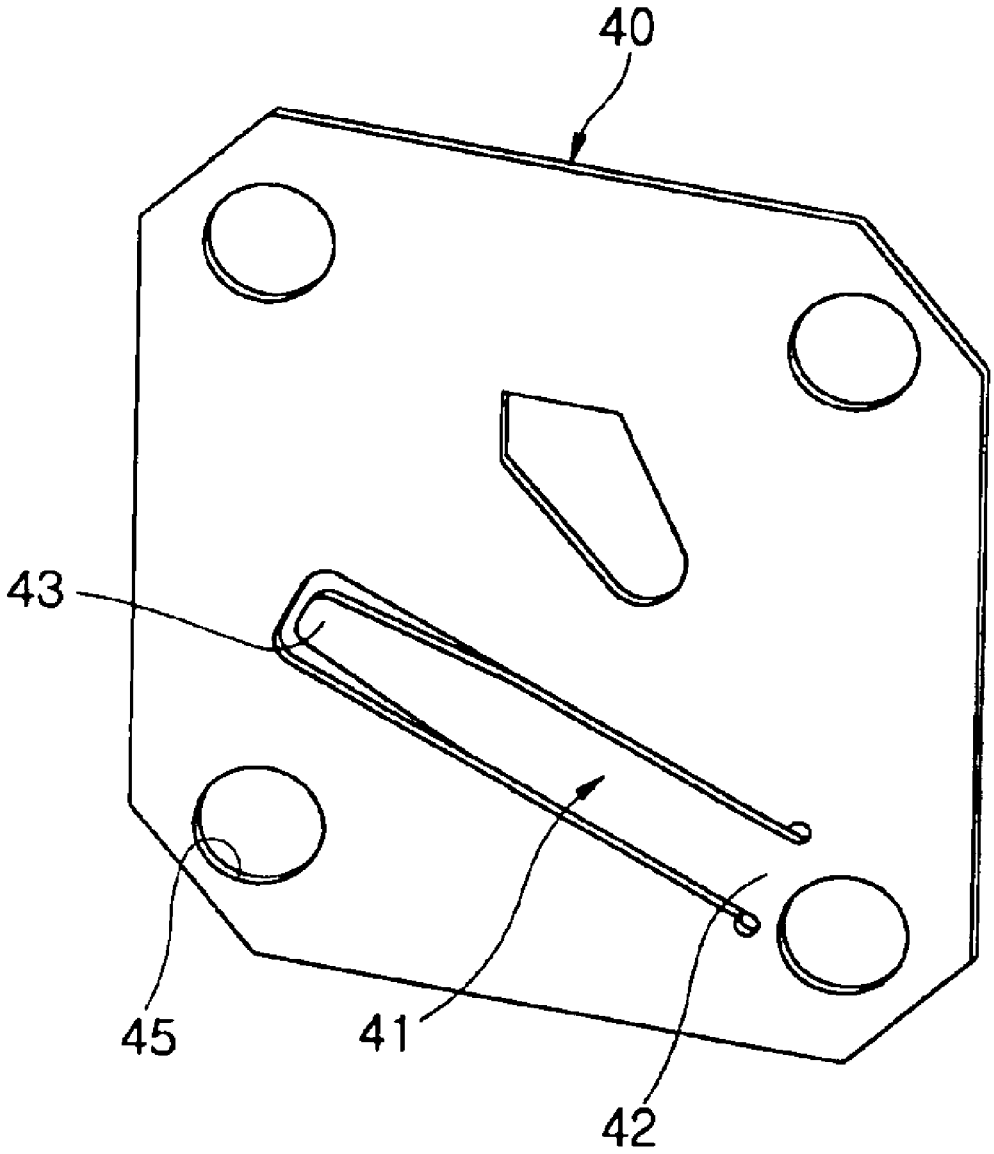
FIG. 4 is a top perspective view of a reed valve plate included in the valve assembly of FIG. 2.
Figure 5:
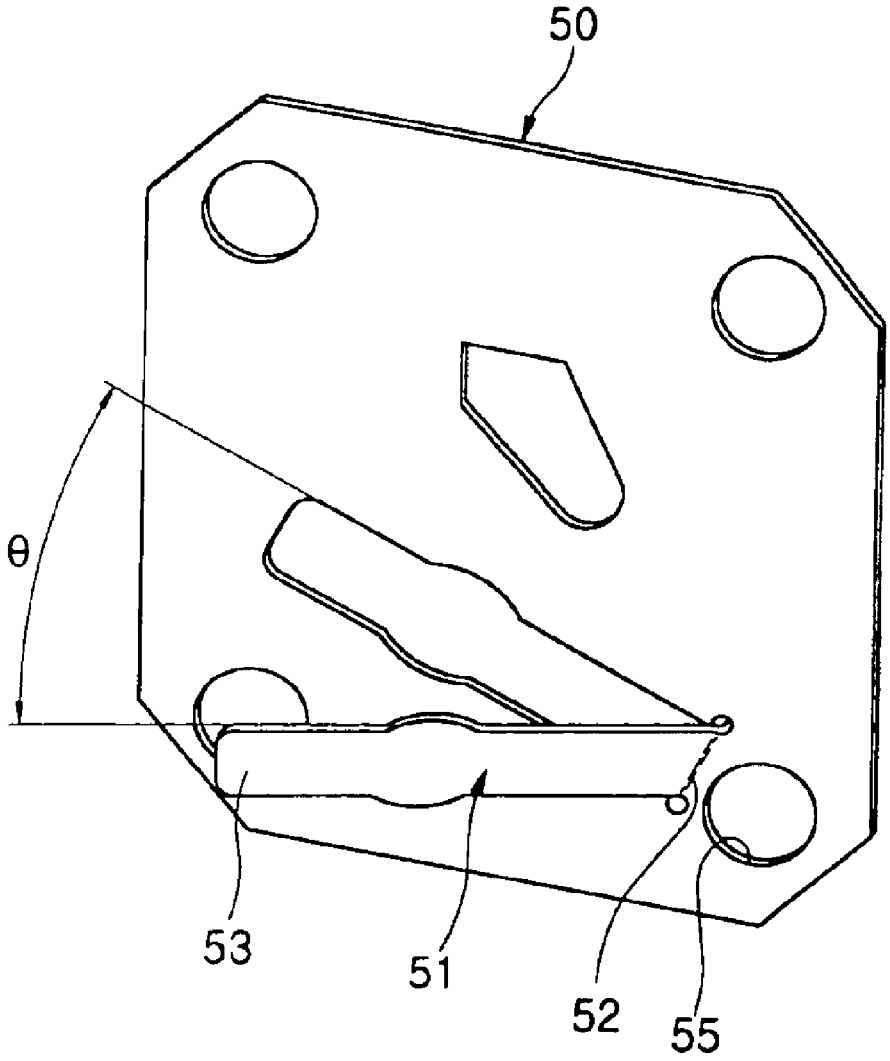
FIG. 5 is a top perspective view of a stopper plate included in the valve assembly of FIG. 2.
Figure 6:
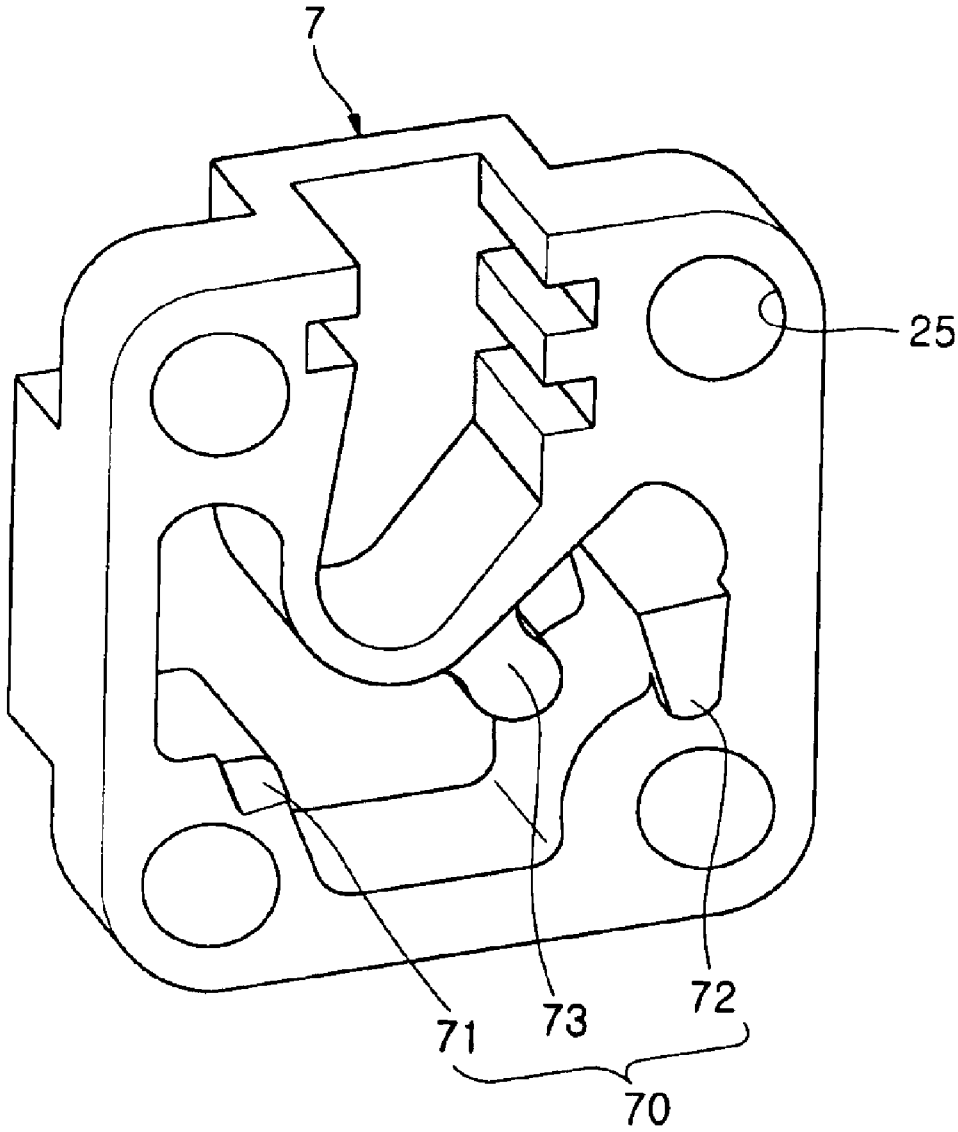
FIG. 6 is a bottom perspective view of a cylinder head which is included in the compressor of FIG. 1, and is assembled with the valve assembly of FIG. 2.

FIGS. 3 to 5 are top perspective views of the exhaust hole plate, reed valve plate, and the stopper plate of the valve assembly of FIG. 2, respectively. FIG. 6 is a top perspective view of the cylinder head which is assembled with the valve assembly of FIG. 2.

As shown in FIG. 3, the exhaust hole plate 30 is a flat plate having a predetermined thickness, with one locking hole 35 formed at each of the rounded corners of the exhaust hole plate 30. The exhaust hole 31 and the suction hole 32 are formed in the exhaust hole plate 30, so that the gas is sucked into the cylinder 4 through the suction hole 32 so as to be compressed in the cylinder 4, prior to being discharged from the cylinder 4 to the outside of the hermetic casing 10 through the exhaust hole 31.

A depression 33 is formed on a surface of the exhaust hole plate 30 at a position around the exhaust hole 31. The depression 33 has a size slightly smaller than that of the reed valve 41 of the reed valve plate 40. Therefore, when the reed valve 41 doses the exhaust hole 31, only a part of the reed valve 41 comes into contact with the areas of the exhaust hole plate 30 around the exhaust hole 31 and the depression 33. The contact area between the reed valve 41 and the surface of the exhaust hole plate 40, when the reed valve 41 closes the exhaust hole 31, is thus reduced, so that it is possible to reduce operational noise of the reed valve 41.

As shown in FIG. 4, the reed valve plate 40 is a flat plate which is remarkably thinner than the exhaust hole plate 30. One locking hole 45 is formed at each of the chamfered corners of the reed valve plate 40. The reed valve 41 is provided in the reed valve plate 40 at a position corresponding to the depression 33 including the exhaust hole 31 of the exhaust hole plate 30, thus opening or closing the exhaust hole 31.

The reed valve 41 is integrally formed in the reed valve plate 40 by cutting a predetermined portion of the reed valve plate 40 along a U-shaped line. The reed valve 41 is thus integrated with a remaining part of the reed valve plate 40 at a first end thereof at which the reed valve 41 is not cut, so that the first end of the reed valve 41 forms a junction end 42. A second end of the reed valve 41, at which the reed valve 41 is separated from the remaining part of the reed valve plate 40, forms a free end 43. The reed valve 41 is elastically bent at the free end 43 so as to open or dose the exhaust hole 31.

As shown in FIG. 5, the stopper plate 50 is a flat plate which is remarkably thinner than the exhaust hole plate 30, in the same manner as that described for the reed valve plate 40. One locking hole 55 is formed at each of the chamfered corners of the stopper plate 50. The stopper 51, having a size corresponding to the reed valve 41, is provided in the stopper plate 50 at a position corresponding to the reed valve 41. The stopper 51 limits an opening ratio of the reed valve 41 within a predetermined range, and applies pre-pressure to the free end 43 of the reed valve 41.

In the same manner as that described for the reed valve 41, the stopper 51 is integrally formed in the stopper plate 50 by cutting a predetermined portion of the stopper plate 50 along a U-shaped line. The stopper 51 is thus integrated with a remaining part of the stopper plate 50 at a first end thereof at which the stopper 51 is not cut and the first end of the stopper 51 forms a junction end 52. A second end of the stopper 51, at which the stopper 51 is separated from the remaining part of the stopper 50, forms a free end 53. The free end 53 of the stopper 51 limits the opening ratio of the reed valve 41 within the predetermined range, and applies the pre-pressure to the free end 43 of the reed valve 41.

The stopper 51 is also bent at the junction end 52 at an inclination angle "θ" relative to the remaining part of the stopper plate 50, so that the free end 53 of the stopper 51 is inclinedly raised toward the cylinder head 7. Therefore, when the stopper plate 50 is set in the valve assembly 20 along with both the reed valve plate 40 and the gasket 60 at a position between the cylinder head 7 and the exhaust hole plate 30, the stopper 51 is compressed at several points thereof by the pressure unit 70 of the cylinder head 7, so that the stopper 51 is supported while being smoothly bent into a bow shape. In such a case, the inclination angle "θ" of the stopper 51 relative to the remaining part of the stopper plate 50 is preferably set to 90° or less.

As shown in FIG. 6, the pressure unit 70 is provided on the lower surface of the cylinder head 7 having one locking hole 25 at each of the rounded corners thereof. The pressure unit 70 compresses the raised stopper 51 at several points to support the stopper 51 while shaping the stopper 51 into the bow shape, thus allowing the stopper 51 to apply the pre-pressure to the free end 43 of the reed valve 41.

The pressure unit 70 includes first, second and third pressure projections 71, 72 and 73. The first pressure projection 71 is formed in the cylinder head 7 at a position corresponding to the junction end 52 of the stopper 51. The second pressure projection 72 is formed in the cylinder head 7 at a position corresponding to the free end 52 of the stopper 51. The third pressure projection 73 is formed in the cylinder head 7 at a position corresponding to an intermediate point of the stopper 51 between the junction end 52 and the free end 53. The arrangement of the three pressure projections 71, 72 and 73 in the cylinder head 7 will be described in detail herein below, with reference to FIGS. 7 and 8.

Figure 7:
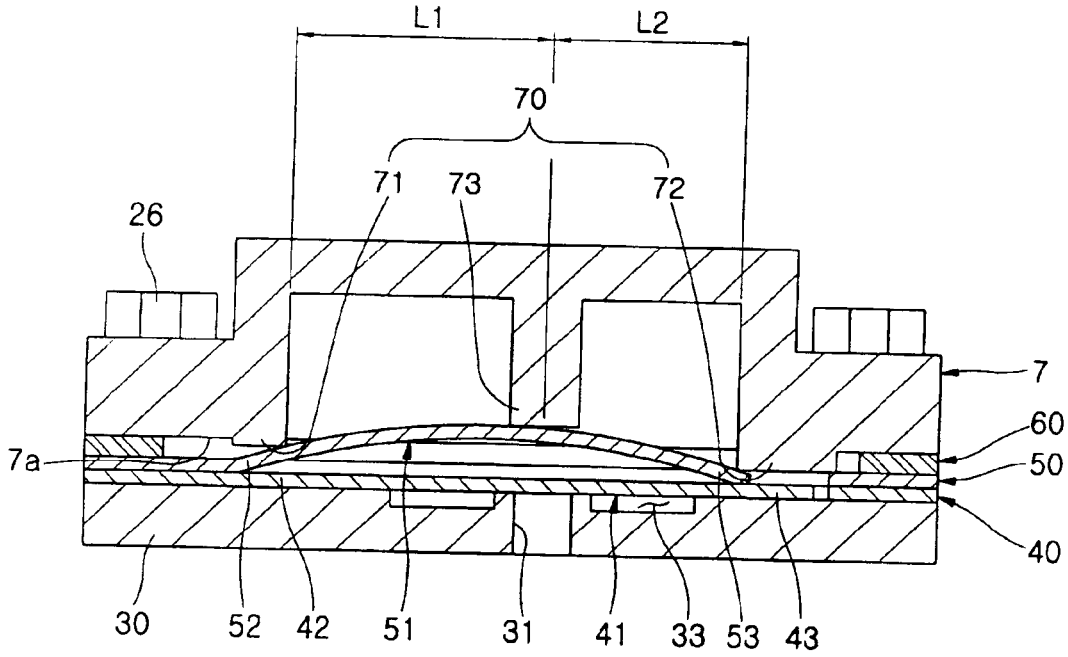
FIG. 7 is an assembly view of the valve assembly of FIG. 2, partially in section, showing the reed valve closing an exhaust hole.
Figure 8:
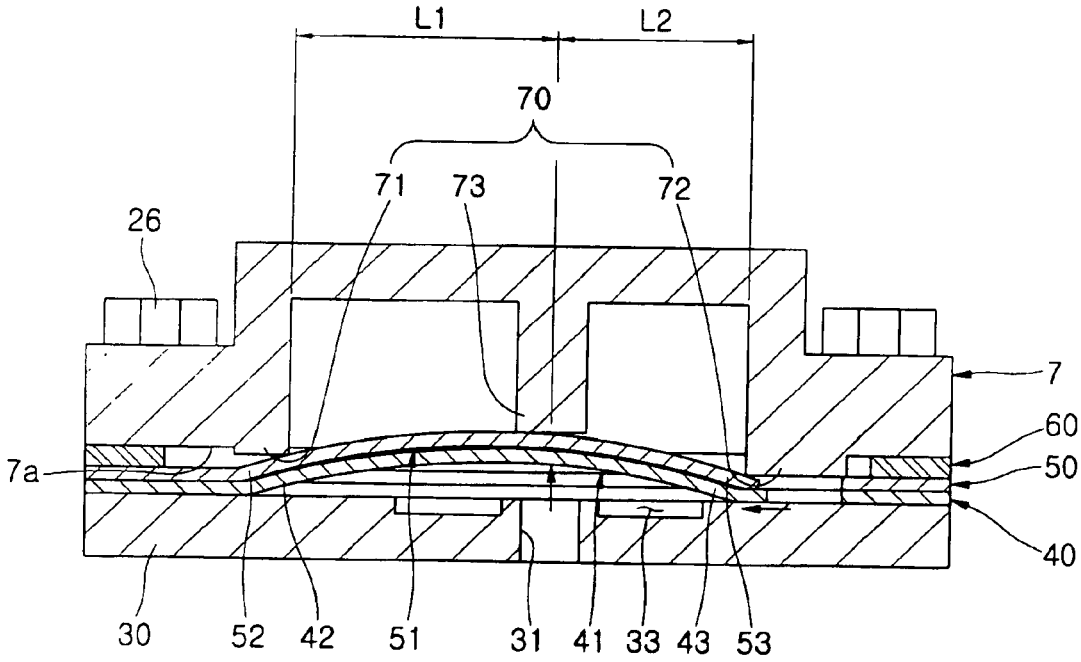
FIG. 8 is similar to FIG. 7 showing the reed valve opening the exhaust hole.

FIGS. 7 and 8 are sectional views taken along the line A—A of FIG. 2, when the reed valve closes and opens the exhaust hole, respectively.

As shown in FIG. 7, the first and second pressure projections 71 and 72 are projected from the lower surface 7*a* of the cylinder head 7 toward the cylinder 4, so that pressure surfaces of the first and second pressure projections 71 and 72 are embossed on the lower surface 7*a*. In such a case, the second pressure projection 72 is slightly longer than the first pressure projection 71, while the third pressure projection 73 is slightly shorter than the first pressure projection 71. That is, the third pressure projection 73 is projected in a depression formed on the lower surface 7*a* of the cylinder head 7, such that a pressure surface of the third pressure projection 73 does not reach a level of the lower surface 7*a*. Therefore, the first, second and third pressure projections 71, 72 and 73 of the pressure unit 70 compress the junction end 52, free end 52 and the intermediate point between the two ends 52 and 53 of the stopper 51, respectively, thus supporting the stopper 51 while shaping the stopper 51 into the bow shape.

In other words, the junction end 52 of the stopper 51, which is connected to the remaining part of the stopper plate 50, is compressed by the first pressure projection 71, thus being held without being moved. The free end 53 of the stopper 51 is slightly compressed by the second pressure projection 72, under the condition that the free end 53 is positioned to be movable toward the junction end 52 through a gap between the cylinder head 7 and the exhaust hole plate 30. In addition, the intermediate point of the stopper 51 between the two ends 52 and 53 is slightly compressed by the third pressure projection 73 which does not reach the level of the lower surface 7*a*, so that the stopper 51 is supported while being bent into the bow shape.

Since the stopper 51 is supported at three points by the first second and third pressure projections 71, 72 and 73 of the pressure unit 70 while the stopper 51 is bent into the bow shape as described above, the free end 43 of the reed valve 41 which is placed between the stopper 51 and the exhaust hole plate 30 is pre-pressurized by the free end 53 of the stopper 51 in a direction toward the exhaust hole plate 30, under the condition that the free end 43 of the reed valve 41 is movable toward the junction end 42.

In addition, the first and third pressure projections 71 and 73 are spaced apart from each other by a distance L1 which is slightly longer than a distance L2 between the second and third pressure projections 72 and 73. That is, the third pressure projection 73 is positioned slightly closer to the second pressure projection 72 than the first pressure projection 71. In other words, the third pressure projection 73 is positioned between the first and second pressure projections 71 and 72, such that the third pressure projection 73 is slightly eccentric toward the second pressure projection 72. Due to the specific arrangement of the first, second and third pressure projections 71, 72 and 73, the reed valve 41 doses or opens the exhaust hole 31 of the exhaust hole plate 30 at a position slightly closer to the free end 43 than the junction end 42 of the reed valve 41. In such a case, the exhaust hole 31 is formed at the exhaust hole plate 30 at a position corresponding to the third pressure projection 73. Therefore, the reed valve 41 accomplishes less deformation during an operation thereof, in comparison wit a conventional valve assembly in which the reed valve closes or opens the exhaust hole at a central position of the reed valve. It is thus possible to reduce operational impact and noise caused by the operation of the reed valve 41 of the present invention. In addition, the above reed valve 41 more smoothly opens or doses the exhaust hole 31.

The valve assembly 20 for reciprocating compressors according to the present invention having the above-mentioned construction is operated as follows. That is, during an operation of the compressor in which the piston 6 is moved to a lower dead center in the cylinder 4, the reed valve 41 is pre-pressurized by the free end 53 of the stopper 51 in a direction toward the exhaust hole plate 30 as shown in FIG. 7. The reed valve 41 in the above state thus doses the exhaust hole 31.

However, when the piston 6 is moved from the lower dead center to an upper dead center in the cylinder 4, a pressure of the gas compressed in the cylinder 4 is increased to become higher than the pre-pressure applied to the reed valve 41 from the stopper 51. Therefore, a part of the reed valve 41, which corresponds to the exhaust hole 31, is moved toward the cylinder head 7 as shown in FIG. 8, and, at the same time, the free end 43 of the reed valve 41 is moved toward the junction end 42. The exhaust hole 31 is thus opened.

During the operation to open the exhaust hole 31, the free end 53 of the stopper 51, which applies the pre-pressure to the free end 43 of the reed valve 41, is slightly moved toward the junction end 52 of the stopper 51 through the gap between the third pressure projection 73 of the cylinder head 7 and the exhaust hole plate 30.

When the piston 6 is moved again from the upper dead center to the lower dead center in the cylinder 4, both the stopper 51 and the reed valve 41 restore original shapes thereof. The reed valve 41 thus closes the exhaust hole 31 again, as shown in FIG. 7.

As apparent from the above description, the present invention provides a valve assembly for reciprocating compressors, elements of which are easily and simply assembled into a single body. That is, a reed valve and a stopper of the valve assembly according to the present invention are respectively integrated with a reed valve plate and a stopper plate which are easily and simply assembled with a cylinder together with a cylinder head by use of a plurality of bolts. The reed valve and the stopper are thus easily and simply assembled into the valve assembly, so that it is possible to conserve time and reduce cost while producing the reciprocating compressors.

In the valve assembly for reciprocating compressors according to the present invention, the stopper is compressed at several points thereof by a pressure unit provided at a lower surface of the cylinder head, so that the stopper is supported while being smoothly bent into a bow shape, and applies pre-pressure to a free end of the reed valve. In addition, the reed valve opens or doses an exhaust hole while a part of the reed valve comes into contact with the exhaust hole at an intermediate portion between the free end and a junction end of the reed valve. Therefore, the valve assembly remarkably reduces operational impact and noise caused by an operation of the reed valve when opening or closing the exhaust hole. Furthermore, the reed valve does not vibrate at the free end thereof, thus reducing high-frequency noise and allowing a silent operation of the reciprocating compressors, and improving the operational performance of the reciprocating compressors.

Although a preferred embodiment of the present invention has been shown and described, it would be appreciated by those skilled in the art that changes may be made in these embodiments without departing from the principles and spirit of the invention, the scope of which is defined in the claims and their equivalents.

What is claimed is:

1. A valve assembly for reciprocating compressors, comprising:

a cylinder;

a cylinder head; and a valve assembly arranged between the cylinder and cylinder head, the valve assembly comprising:

an exhaust hole plate having an exhaust hole communicating with the cylinder;

a reed valve plate, with a reed valve integrally formed in the reed valve plate so as to open or close the exhaust hole;

a stopper plate, with a stopper integrally formed in the stopper plate so as to limit an opening degree of the reed valve within a predetermined range, the exhaust hole plate, the reed valve plate and the stopper plate being assembled with the cylinder together with the cylinder head when the cylinder head is mounted to the cylinder; and a pressure unit integrally formed on a lower surface of the cylinder head so as to compress the stopper to support the stopper, and allow the stopper to apply pre-pressure to the reed valve.

2. The value assembly according to claim 1, wherein the reed valve is formed by cutting a predetermined portion of the reed valve plate, such that a first end of the reed valve forms a junction end, and a second end of the reed valve forms a free end.

3. The valve assembly according to claim 2, wherein the stopper is formed by cutting a predetermined portion of the stopper plate, such that a first end of the stopper forms a junction end, and a second end of the stopper forms a free end, the stopper being bent at the junction end thereof at a predetermined angle of inclination, so that the free end of the stopper is raised toward the cylinder head.

4. The valve assembly according to claim 3, wherein the pressure unit comprises:

a first pressure projection projected from the cylinder head at a position corresponding to the junction end of the stopper, thus compressing the junction end of the stopper;

a second pressure projection projected from the cylinder head at a position corresponding to the free end of the stopper, thus compressing the free end of the stopper; and a third pressure projection projected from the cylinder head at a position corresponding to an intermediate point of the stopper between the junction end and the free end of the stopper, thus compressing the intermediate point of the stopper.

5. The valve assembly according to claim 4, wherein the second pressure projection is slightly longer than the first pressure projection, and the third pressure projection is slightly shorter than the first pressure projection, so that the first, second and third pressure projections support the stopper while shaping the stopper into a bow shape at a position between the cylinder head and the exhaust hole plate, and the free end of the reed valve is pre-pressurized by the free end of the stopper which is compressed by the second pressure projection.

6. The valve assembly according to claim 5, wherein the third pressure projection is eccentrically positioned between the first and second pressure projections, and the exhaust hole is formed at the exhaust hole plate at a position corresponding to the third pressure projection.

7. The valve assembly according to claim 6, wherein the third pressure projection is positioned to be eccentric toward the second pressure projection.

8. The valve assembly according to claim 6, wherein a depression is formed on a surface of the exhaust hole plate at a position around the exhaust hole, so that the reed valve closes the exhaust hole while a part of the reed valve comes into contact with areas of the exhaust hole plate around the exhaust hole and the depression.

* * * * *